US008109016B2

(12) United States Patent
Keough

(10) Patent No.: US 8,109,016 B2
(45) Date of Patent: Feb. 7, 2012

(54) ADJUSTABLE GOLF SPIKE

(76) Inventor: David B. Keough, Sandy, UT (US)

( * ) Notice: Subject to any disclaimer, the term of this patent is extended or adjusted under 35 U.S.C. 154(b) by 551 days.

(21) Appl. No.: 12/350,660

(22) Filed: Jan. 8, 2009

(65) Prior Publication Data

US 2009/0172975 A1 Jul. 9, 2009

Related U.S. Application Data

(60) Provisional application No. 61/019,761, filed on Jan. 8, 2008.

(51) Int. Cl.
*A43B 5/00* (2006.01)

(52) U.S. Cl. ..... 36/134; 36/127

(58) Field of Classification Search ..... 36/127, 36/134, 67 D, 61
See application file for complete search history.

(56) References Cited

U.S. PATENT DOCUMENTS

| | | | | |
|---|---|---|---|---|
| 3,951,407 | A * | 4/1976 | Calacurcio | 36/127 |
| 4,081,918 | A * | 4/1978 | O'Brien | 36/132 |
| 4,318,232 | A * | 3/1982 | Ching | 36/73 |
| 5,243,775 | A * | 9/1993 | Swain | 36/134 |
| 6,543,160 | B2 * | 4/2003 | Price | 36/127 |
| 7,722,473 | B1 * | 5/2010 | Shah | 473/218 |
| 2003/0056401 | A1 * | 3/2003 | Kwon | 36/127 |

* cited by examiner

*Primary Examiner* — Ted Kavanaugh

(57) ABSTRACT

An adjustable golf spike assembly for a golf shoe includes a receptacle fixedly attached to the sole of the golf shoe. The receptacle defines an octagonal recess and an octagonal, externally threaded post disposed within the recess. A cleat includes an oversized gripping portion for providing traction and an attachment portion extending from the gripping portion. The attachment portion has an octagonal outer surface to match and engage with the octagonal recess and an octagonal threaded recess for engaging with the threads of the receptacle. Rotation of the cleat relative to the receptacle longitudinally moves the gripping portion relative to the receptacle. Engagement between the upper portion of the cleat and the receptacle provides for discrete rotational positioning of the cleat relative to the receptacle to position and hold the cleat a desired distance from the receptacle.

19 Claims, 11 Drawing Sheets

ADJUSTABLE GOLF SPIKE

CROSS REFERENCE TO RELATED APPLICATION

This invention claims priority to U.S. Provisional Patent Application Ser. No. 61/019,761 filed on Jan. 8, 2008, the entirety of which is incorporated by this reference.

FIELD OF THE INVENTION

This in invent relates general to golf spikes, and more specifically to a golf spike that allows for height adjustment of the spike relative to a golf shoe and where the spikes form the primary support surface or sole of the shoe.

BACKGROUND OF THE INVENTION

Golf spikes are used on golf shoes to prevent unwanted slipping of the feet relative to the ground during a golf swing. Typically, a golf shoe will include eight to ten golf spikes per shoe distributed along the sole of the shoe. Golf spikes are attached to the shoe by threaded engagement with the golf spike having an externally threaded stud and the golf shoe providing a fixedly mounted internally threaded receptacle. The golf spike is tightened, as with a spike wrench, to secure the spike to the shoe. "Soft" spikes have a plastic gripping portion that is configured to provide traction while reducing penetration into the surface of a putting green to reduce damage to the green that can be caused by conventional metal spiked golf shoes. The soft spikes have an effective diameter that is typically about one inch.

It would be desirable, however, to provide a golf spike in a golf shoe that is vertically adjustable relative to the sole of the shoe to allow the golf spike extend various distances from the sole of the golf shoe in order to correct balance and/or stance problems that may be present in the golf stance of a person wearing such golf shoes. It would also be desirable to provide a pair of golf shows with a cleat system that is adjustable for practice and training and then adjustable to the same relative height to make them conform to the United States Golf Association's Rules of Golf.

SUMMARY OF THE INVENTION

Often, a golfer at any skill level has problems associated with his or her stance and/or balance throughout a golf swing. It is important in a golf swing to ensure that proper stance and balance is maintained throughout the swing. For example, placing too much weight on the heels or toes during a golf swing can result in an unbalanced golf swing that will affect the golfer's ability to consistently hit straight shots and/or hit the ball on the center of the clubface. Because balance is a matter of feel in the feet of the golfer, what may feel natural or correct to the golfer, may actually be incorrect when viewed by a person skilled in the art of golf instruction. Teaching someone how to change their balance feel, however, is often a fruitless endeavor, especially once the golfer is on a golf course or a practice range without an instructor overseeing their swing mechanics.

Often, a golf instructor will place an object, such as a golf ball, wedge, sponge or other object under one or both of the soles of the golfer's shoes to provide the golfer with a feel for placing and maintaining various degrees of the golfer's weight on certain parts of their feet in order to help correct a particularly identified weight imbalance issue. The present invention eliminates the need for such objects while allowing the golfer to correct their balance problems by physically raising or lowering the golf spikes on the golf shoe in order to change their stance and weight distribution on the soles of the golf shoes.

Accordingly, an adjustable golf cleat is provided that can be selectively extended a distance from the sole of a golf shoe. By including a plurality of such golf cleats on the sole of a golf shoe and adjusting the golf cleats to various heights, the golf shoe can help a golfer to correct an unbalanced golf swing.

The golf cleat of the present invention is received within a cleat receptacle that is attached within the sole of a golf shoe. The receptacle includes an inner recess for receiving an attachment portion of the golf cleat. The recess and the attachment portion have mating, non-circular surfaces so as to provide select rotational engagement between the cleat and the receptacle. In addition, the cleat includes an inner recess having a non-circular configuration with an interior worm gear thread disposed thereon for engaging with in a threaded fashion a non-circular post with an exterior worm gear thread disposed within the recess of the receptacle. Thus, the height of the cleat relative to the receptacle can be selectively adjusted by a user.

In another embodiment, the cleat is oversized. A golf shoe includes a plurality of the oversized cleats to form the primary walking surface of the shoe.

In another embodiment, the cleat engages the sole of the shoe to cause the sole to move with the cleat as the cleat is adjusted to prevent debris from entering the receptacle of the cleat.

DETAILED DESCRIPTION OF THE ILLUSTRATED EMBODIMENTS

Figure 1:
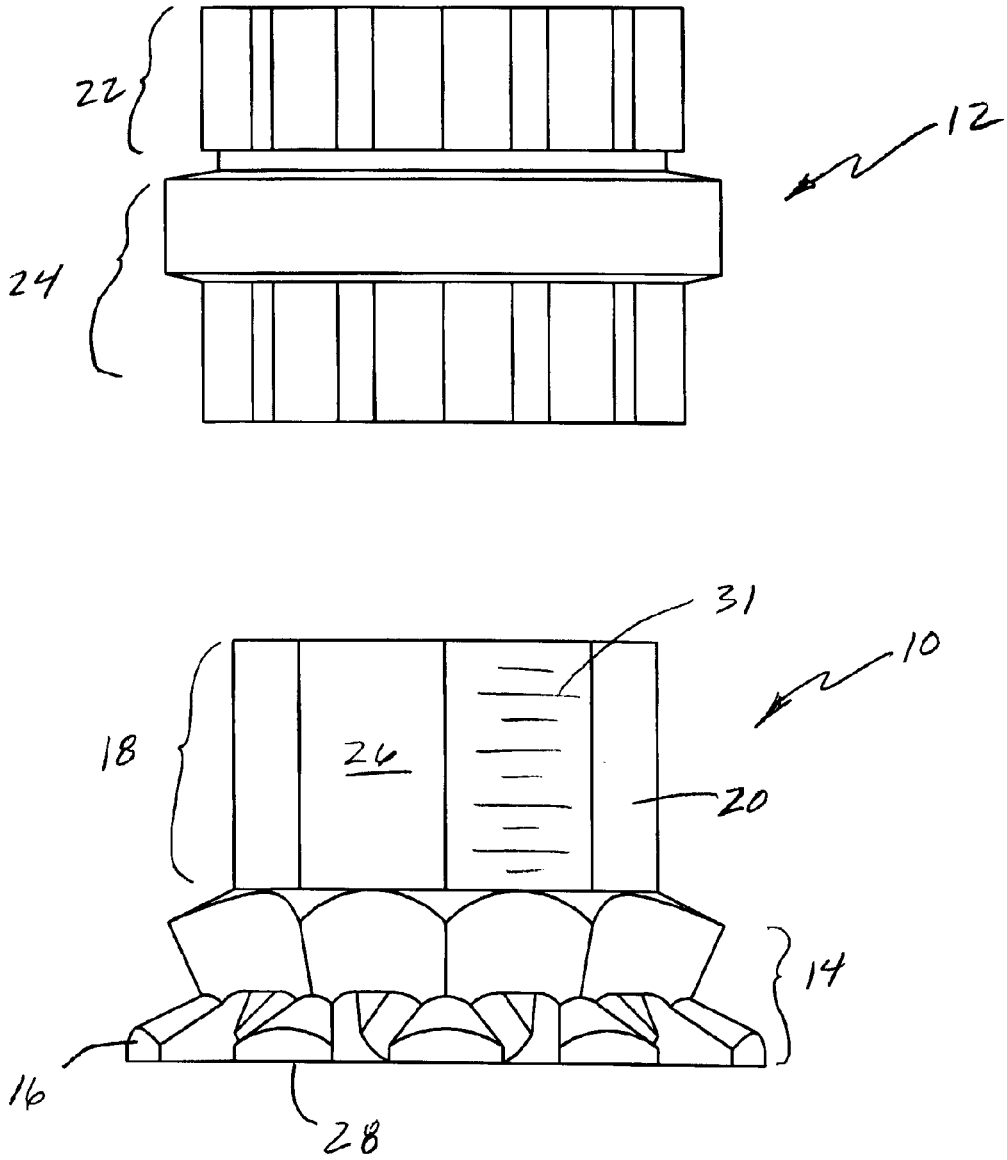
FIG. 1 is a side view of a golf shoe receptacle and cleat in accordance with the principles of the present invention.

As shown in FIG. 1, there is illustrated a golf cleat or spike, generally indicated at 10, and a golf spike receptacle, generally indicated at 12. The golf spike 10 is comprised of a lower gripping portion 14 that includes a plurality of protrusions 16 for gripping a surface upon which a golfer may be standing, such as grass to function as a "soft" spike. The upper portion 18 of the golf spike 10, which may be integrally formed with the lower portion 14 or separately constructed and mechanically or chemically attached thereto, provides an adjustable coupling structure for attaching the spike 12 to the receptacle 12. The gripping portion 14 is "oversized" and has an effective diameter that is two to three times larger or more than the diameter of conventional soft golf spikes (i.e., golf spikes configured not to penetrate the green surface to reduce damage to greens). For example, the effective diameter (defined by the outer edge of the protrusions 16) may be 1.5 inches or more, with a particular effective diameter of about 2 inches. This allows for the use of fewer cleats per shoe to cover a substantial portion of the sole of the shoe, and requiring the user to adjust fewer cleats to achieve the desired balance feel effect by raising and/or lowering certain cleats.

The receptacle 12 is provided with an upper shoe attachment portion 22 configured for being embedded within and fixedly attached to the sole of a golf shoe (not shown). The lower portion 24 is configured to receive the upper portion 18 of the golf spike and retain the upper portion 18 relative thereto. The upper portion 18 is provided with an octagonally shaped outer surface 26 to engage with a similarly configured octagonal-shaped inner recess, as will be more fully described herein, for locking the spike 10 to the receptacle 12 at various distances between the receptacle 12 and the bottom surface 28 of the gripping portion 14. When the upper portion 18, which may be approximately 0.5 inches in length, of the spike 10 is threaded into lower portion 24 of the receptacle 12, the outer surface 26 provides discrete resistance to relative rotation of the two components 10 and 12 to provide discrete positions of the spike 10 to the receptacle 12 and thus discrete spacing of the bottom surface 28 to the receptacle 12. The upper portion 18 may be provided with indicator lines 31 to provide a visual indicator for various spike 10 to receptacle 12 positions.

Figure 2:
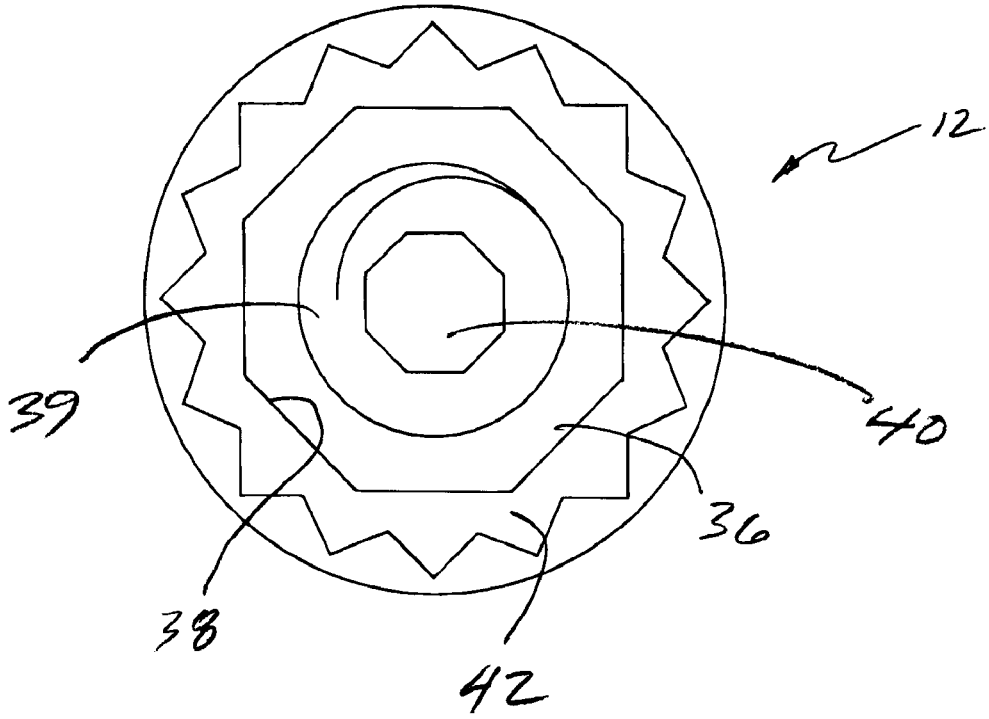
FIG. 2 is a top view of the golf shoe receptacle and cleat shown in FIG. 1.
Figure 2:
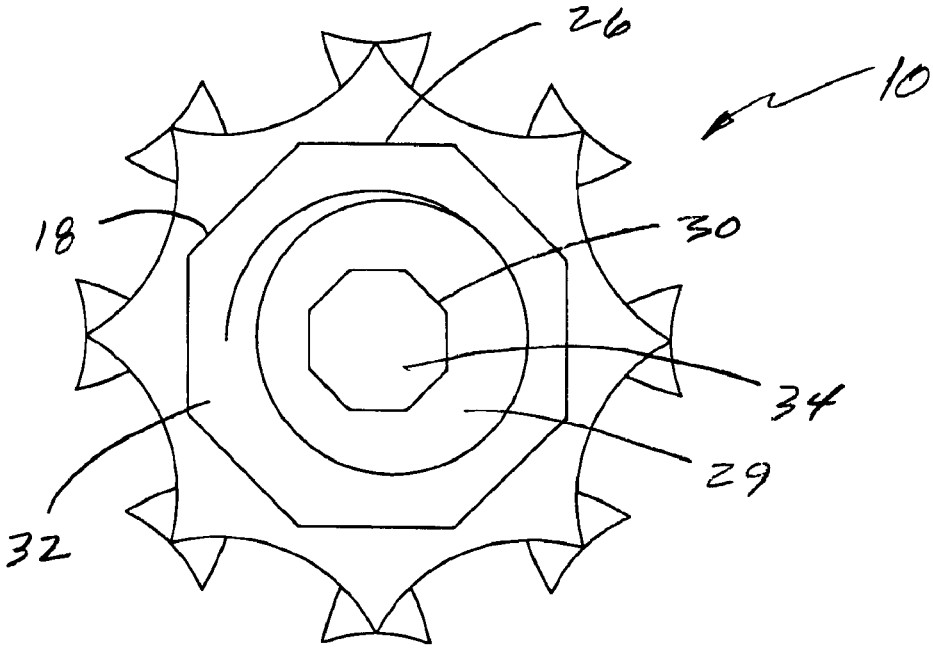

As shown in FIG. 2, the upper portion 18 of the spike 10 defines the outer octagonal surface 26. The upper portion 18 also defines an internally threaded bore 29 disposed within the upper portion 18. An inner octagonal post member 30 is disposed within and substantially concentric with the bore 29. The upper portion 18 thus includes an outer insert member 32 and an inner insert member 34 for being received within the receptacle 12. The receptacle defines an octagonally shaped recess 36 sized for receiving the outer insert member 32 and for forming a friction fit therewith. The engagement of the surface 26 with the inner surface 38 prevents unwanted relative rotation of the two components. Disposed within the recess 36 is an externally threaded post 39 configured for threading with the internally threaded outer insert member 32. The post 39 defines a second inner octagonal recess 40 sized for receiving and forming a friction fit with the inner insert 34 to provide additional resistance to relative rotation. When threadedly engaged, the outer insert member 32 fits snugly within the outer wall 42 of the receptacle. The outer wall 42 thus acts as a protective sleeve around the upper portion 18 of the spike 10 to prevent dirt or other debris from entering the receptacle 12 and from otherwise affecting the performance of the engagement between the receptacle 12 and spike 10. It is noted that the outer surface could be of any geometric shape that generate substantial resistance to rotation when engaged with the receptacle 12 to prevent unwanted rotation of the spike 10 relative to the receptacle 12. In addition, while the exemplary embodiment shows the engagement surfaces of the spike 10 and receptacle 12 of similar geometric shapes, it may also be the case that the shapes be different so long as they provide adequate engagement relative to one another. The combined engagement of the outer octagonal surfaces, inner octagonal surfaces and threaded engagement allows the spike to be set at any discrete height relative to the receptacle, from fully inserted to nearly fully extended.

Figure 3:
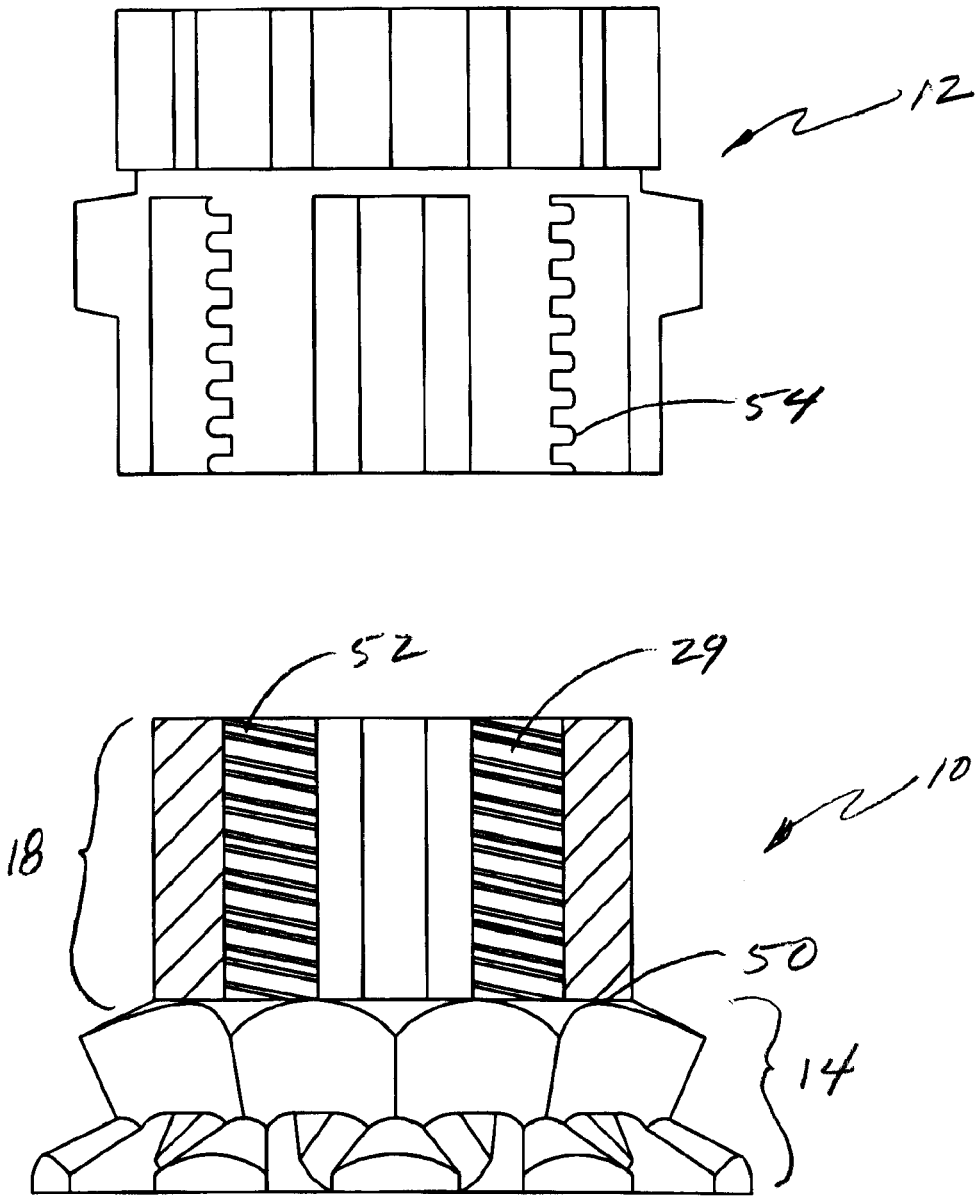
FIG. 3 is a cross-sectional side view of the golf shoe receptacle and cleat shown in FIG. 1.

As more fully illustrated in FIG. 3, the upper portion 18 of the spike 10 includes an internally threaded bore 29 that extends the length of the upper portion 18 to the top 50 of the gripping portion 14. The threads 52 have a trapezoidal cross-section to engage with trapezoidally-shaped external threads 54 and to provide greater frictional contact there between. The threads 52 and 54 are in a "worm gear" configuration with relatively large and deep threads to provide substantial surface contact between the threads 52 and 54.

The receptacle 12 and spike 10 may be molded from a hard durometer rubber, plastic or other material known in the art. The hardness of the material, to a large extent, determines the relative resistance to turning of the spike 10 to the receptacle 12. As previously discussed, the spike 10 and receptacle 12 may each be integrally formed as illustrated herein, or formed from individual components that are later molded, bonded or otherwise mechanically attached.

Figure 3A:
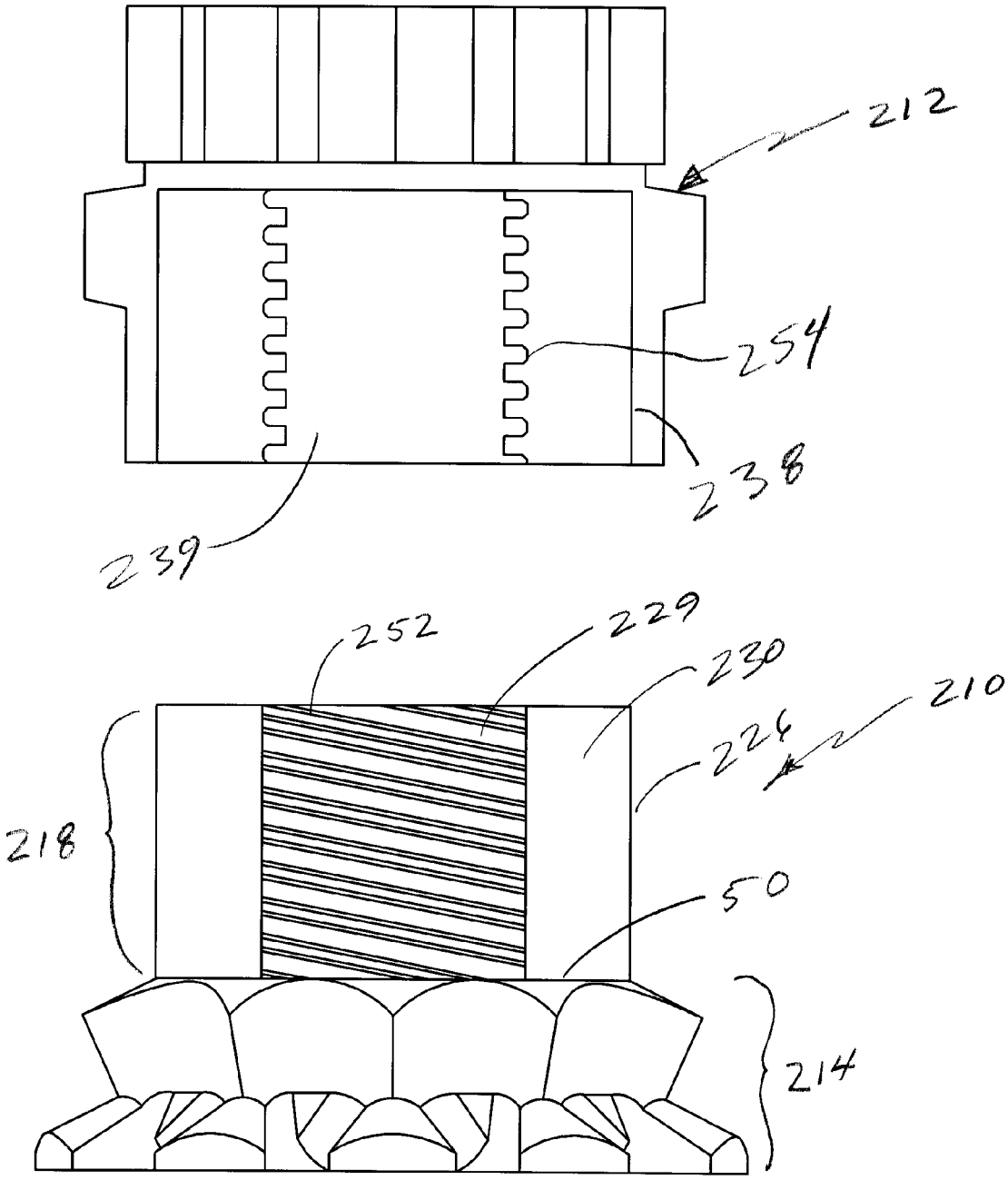
FIG. 3A is a cross-sectional side view an alternate embodiment of a golf shoe receptacle and cleat in accordance with the principles of the present invention.

As shown in FIG. 3A, the upper portion 218 of the spike 210 includes an internally threaded bore 229 that extends the length of the upper portion 218 to the top 250 of the gripping portion 214. The threads 252 have a trapezoidal cross-section to engage with trapezoidally-shaped external threads 54 and to provide greater frictional contact there between. The threads 52 and 54 are in a "worm gear" configuration with relatively large and deep threads to provide substantial surface contact between the threads 52 and 54. Unlike the spike 10 shown in FIG. 3, the spike 210 does not include the octagonal post or mating recess. Rather, the wall 230 defining the threads 252 and externally threaded post 239 have been made relatively thicker to provide added rigidity to the post 239 and upper portion 218 so that the engagement of the octagonal threads 252 and 254 as well as the outer surface 226 and inner surface 238 of the receptacle 212 hold the spike 210 relative to the receptacle 212 at any desired engaging position to selectively increase or decrease the height of the spike 210 relative to the receptacle 212.

Figure 4:
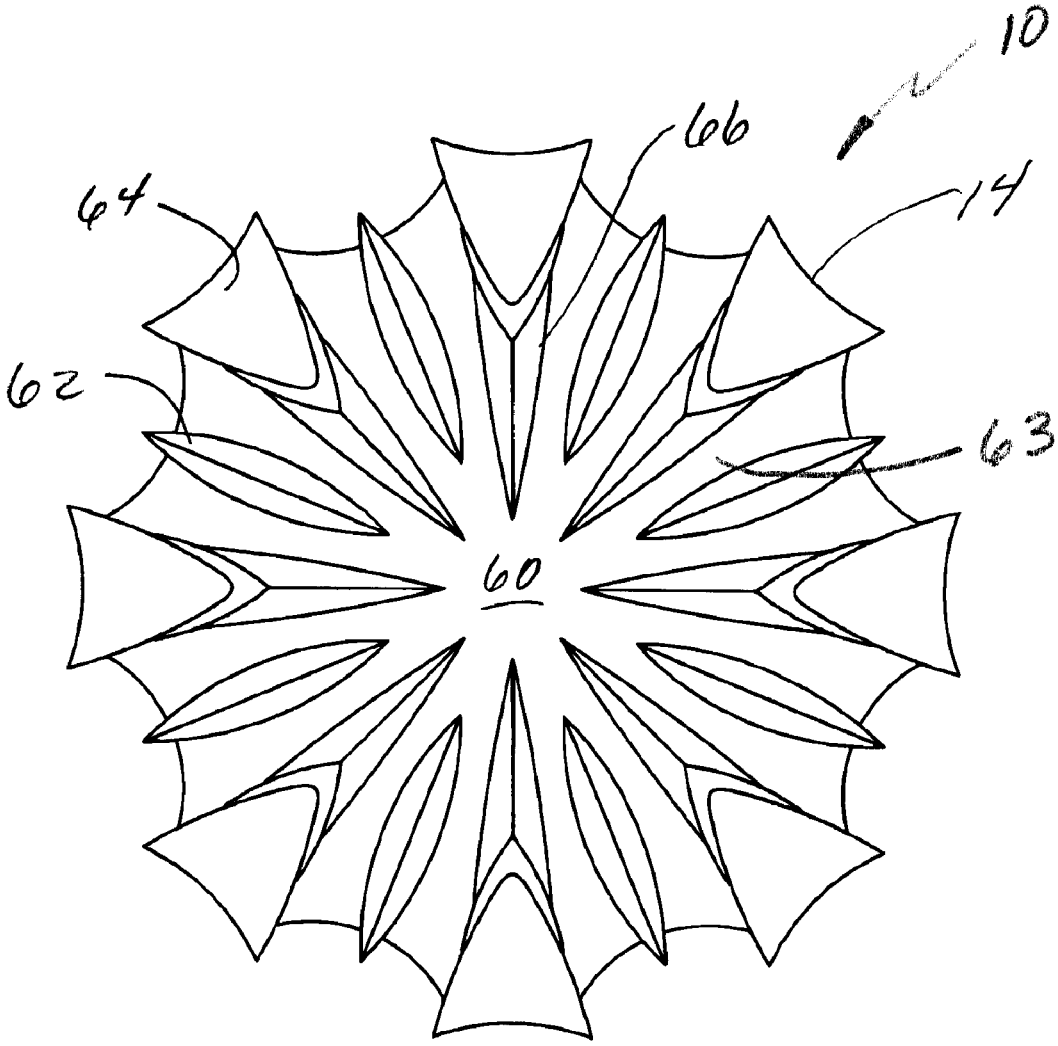
FIG. 4 is a bottom view of the golf cleat illustrated in FIG. 1

As shown in FIG. 4, the gripping portion 14 is of a configuration that provides a relatively large surface 60 area for providing balance while providing various protrusions 62 and 64 for gripping a surface, such as grass. Thus, the gripping portion 14 includes a plurality of radially spaced feet 64 with a plurality of radially spaced blades 62 interposed therein between. In addition, a plurality of radially spaced blades 66 extends from the inside of the feet 64 toward the center of the surface 60. The relative height or elevation of each protruding part of the gripping portion, including the feet 64 and blades 62 are substantially the same so as to reduce or eliminate damage to the surface of a green. The recesses or grooves 63 formed between each blade 62 and foot 64 are not of consistent width such that each groove 63 narrows toward the center of the groove 63. This allows the gripping portion 14 to capture blades of grass within each groove 63 to effectively increase the gripping ability of the gripping portion 14.

The surface 60 of the cleat 10 may be substantially oversized relative to a typical golf spike known in the art (e.g., two to three times larger). This allows the cleat 10 to cover a larger surface area per cleat 10 of the sole of a golf shoe. Thus, fewer cleats will be necessary to cover the sole of a golf shoe.

Figure 5A:
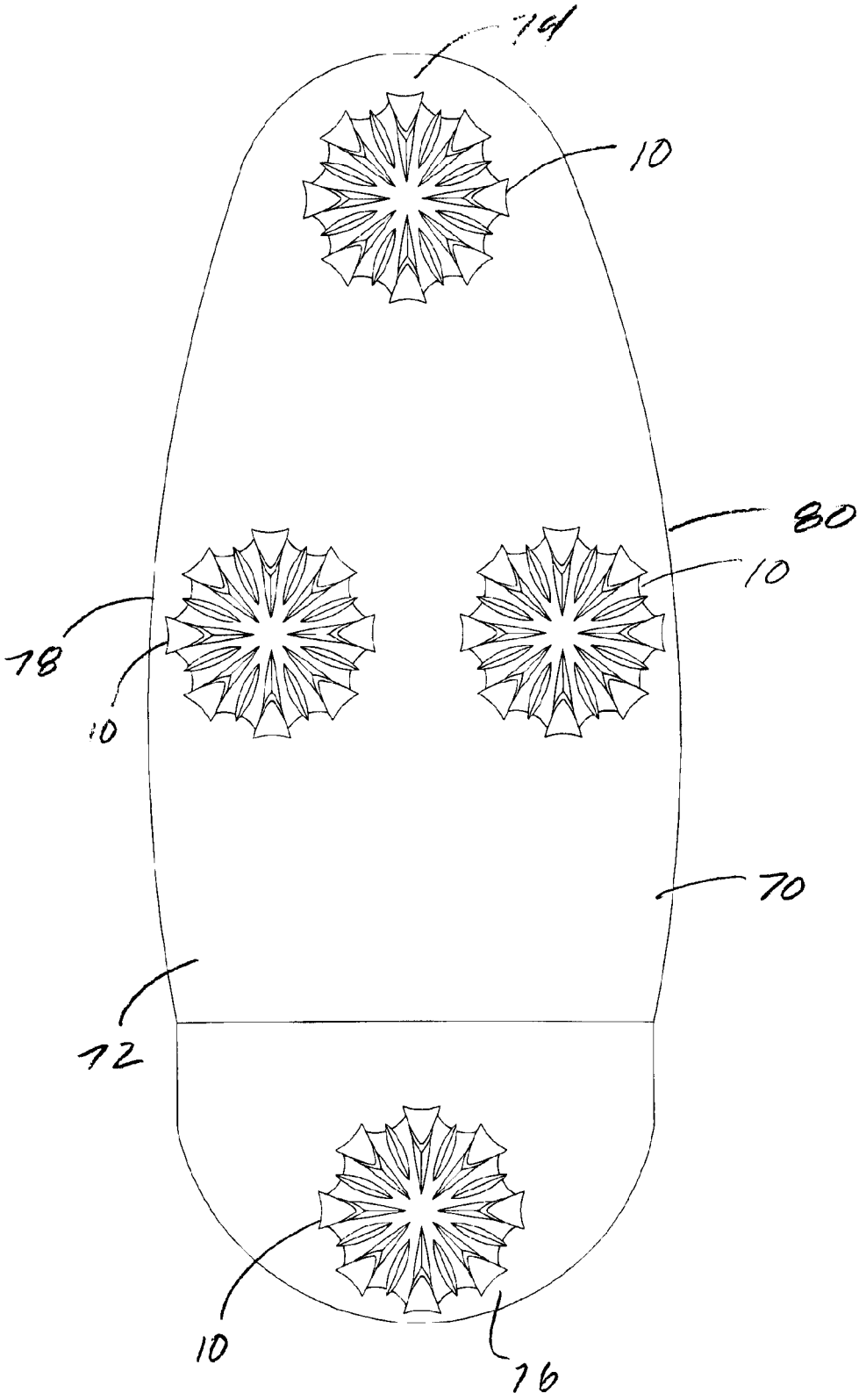
FIG. 5A is a bottom view of a plurality of golf cleats shown in FIG. 1 attached to the bottom of a golf shoe.

As shown in FIG. 5A, a plurality of golf spikes 10 are attached to a golf shoe 70. The golf spikes 10 are distributed about the sole 72 of the shoe 70 with one spike near the toe 74, one spike near the heel 76 and spikes near the left side 78 and right side 80. This distribution and arrangement of spikes 10 about the sole 72 allows a golfer to adjust the height of each spike 10 relative to the sole 72 to correct any balance anomaly. For example, if the golfer tends to place too much weight on the toes when swinging, the spike 10 near the tow 74 can be extended to lift the toes of the golfer in a golf stance. This will cause the golfer to naturally put more weight toward the heels. Conversely, if the golfer tends to swing with excessive weight on the heels, the spikes 10 near the heel 76 can be extended to cause the golfer to balance more toward the toe 74. In addition, to prevent swaying or shifting of weight outside of the stance of the golfer, the spike 10 on the outside of the foot may be extended to cause more weight to be placed on the inside of the foot during the swing. As desired, various combinations of extended and retracted spikes 10 may be employed to customize the golf shoe 70 to a particular golfer. Also, because of the oversized nature of the golf spikes 10, fewer numbers of spikes 10 are needed for a given shoe, thus reducing the number of spikes that have to be adjusted for a particular balance problem.

Figure 5B:
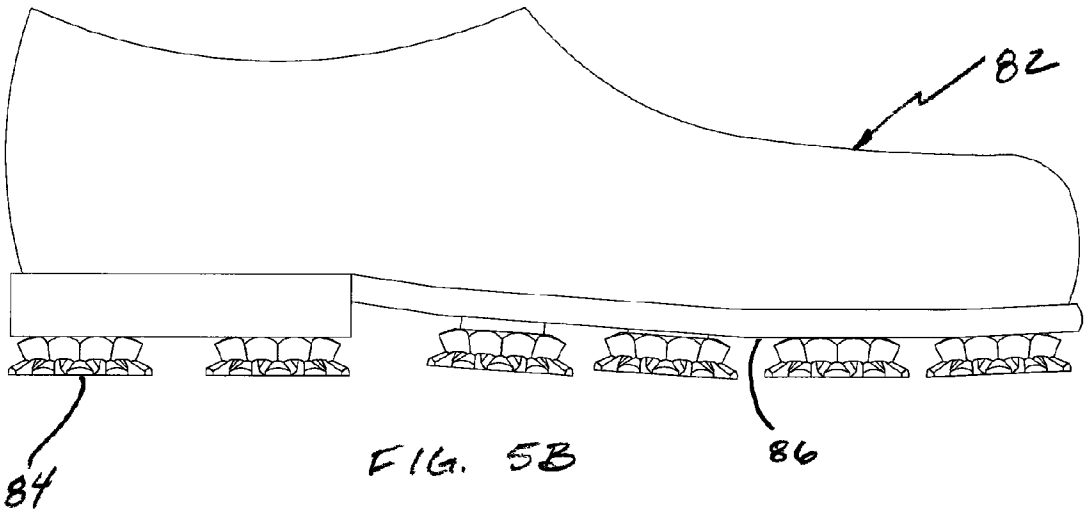
FIG. 5B, is a side view of a plurality of golf cleats shown in FIG. 1 attached to the bottom of another golf shoe.
Figure 5C:
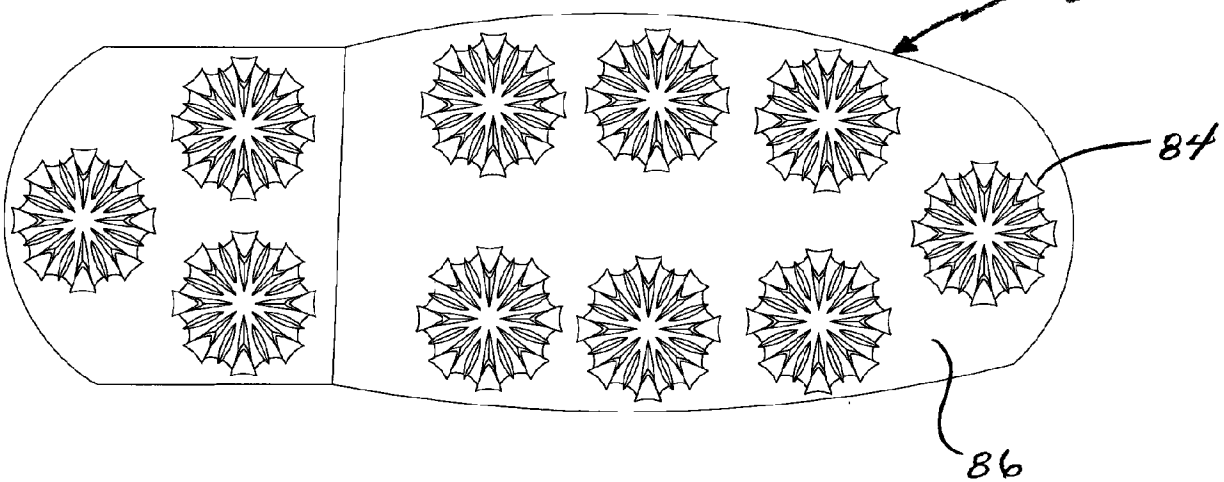
FIG. 5C, is a bottom view of the plurality of golf cleats attached to the golf shoe shown in FIG. 5B.

As further illustrated in FIGS. 5B and 5C, a golf shoe 82 is provided with a plurality of cleats 84 attached to the sole 86 of the shoe. The number of cleats 84 has been increased from that shown in FIG. 5A to include ten such cleats 84. The number of cleats 84 may be increased or decreased, and their relative arrangement on the sole, depending on the shoe size and the relative spacing of the cleats 84 (e.g., 8, 9, 10, 11 or 12 cleats 84). By closely spacing the cleats 84, the cleats 84 function as the primary sole of the shoe 82 such that when a user walks in the shoe 82, the cleats 84 form the walking surface. Also, increasing the number of cleats 84 to substantially cover the sole 86 of the shoe prevents the wearer from feeling the cleats 84 through the sole 86 of the shoe 82. Each cleat 84 can be adjusted up or down relative to the sole 86 to provide varying cleat heights in order to correct balance issues as described with reference to FIG. 5A.

Figure 6:
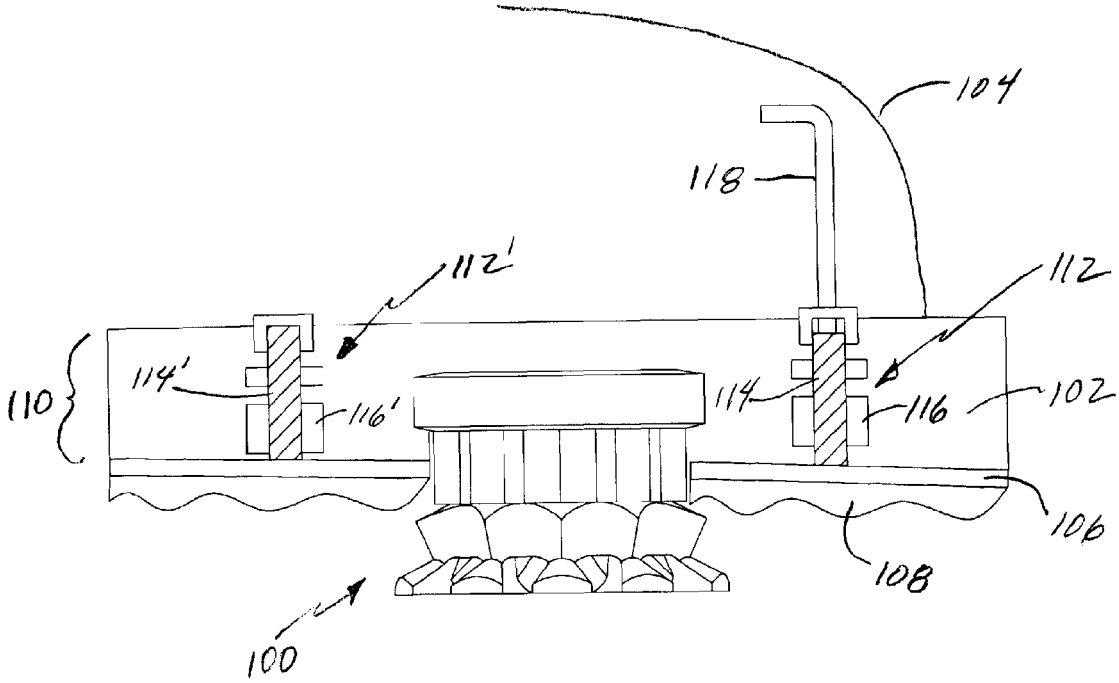
FIG. 6 is a partial cross-sectional side view of a golf cleat and receptacle of the present invention attached to a sole of a golf shoe in accordance with the principles of the present invention.

As shown in FIG. 6, in order to provide additional adjustability to a golf spike assembly 100 in accordance with the present invention, a sole 102 of a golf shoe 104 may be made adjustable as well such that the sole 102 can be stretched around the golf spike assembly 100, Embedded within the sole 102 is a rigid plate member 106. The plate member 106 is positioned above and attached to the tread portion 108 of the sole 102. A layer 110 of flexible sole material is positioned above the plate member 106 and fixedly attached thereto. A plurality of sole adjustment assemblies 112 are positioned adjacent the golf spike assemblies 100. The sole adjustment assemblies 112 are comprised of an externally threaded hex bolt 114 threadedly engaged into an internally threaded housing 116. The housing 116 is embedded within and fixedly attached to the layer 110. By using a hex wrench 118, the hex bolt 114 can rotated relative to the housing 116 to extend the bolt 114 from the distal end of the housing 116 causing the plate 106 to be forced away from the distal end of the housing 116 and thus effectively widen the sole 102 at that location. This effectively causes the spike assembly 100 to be further retracted into the sole 102. Conversely, as the hex bolt 114' of the sole adjustment assembly 112' is retracted within the housing 116', the plate 106 and thus the thread portion 108 is in a non-stretched state to expose more of the spike assembly 100.

Figure 7:
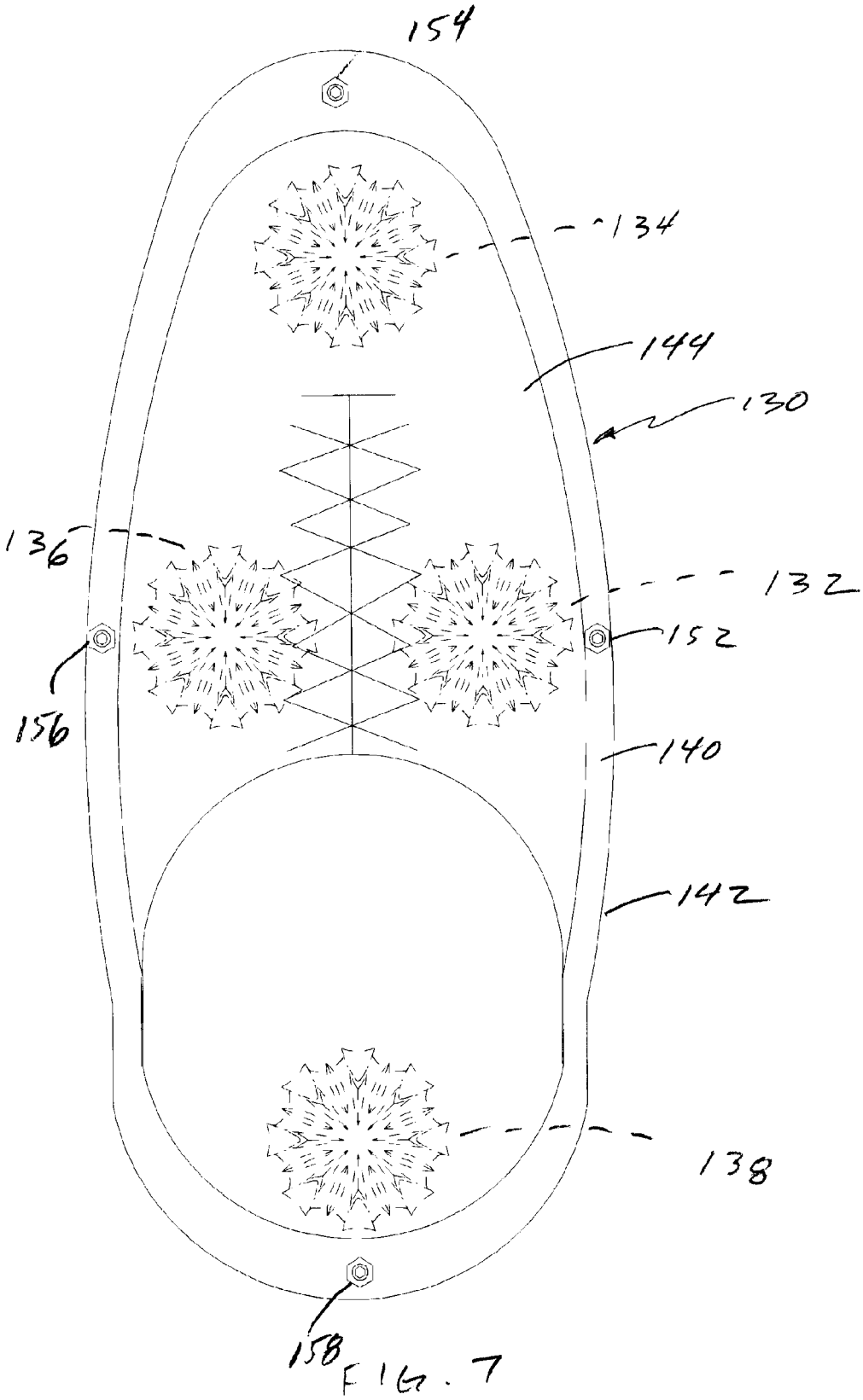
FIG. 7 is a top view of a golf shoe having an adjustable sole in accordance with the principles of the present invention.

As shown in FIG. 7, a golf shoe 130 includes a plurality of adjustable golf spike assemblies 132, 134, 136 and 138. The top surface 140 surface of the sole 142 extends around the perimeter of the shoe upper 144. A plurality of sole thickness adjustment members 152, 154, 156 and 158 are embedded within the sole 142 and positioned proximate a respective adjustable spike assembly 1332, 134, 136 and 138. Each sole thickness adjustment members 152, 154, 156 and 158 are each provided with exposed hex bolts (as previously described) to allow for adjustment of the hex bolts from the top surface 140 of the sole 142.

Figure 8:
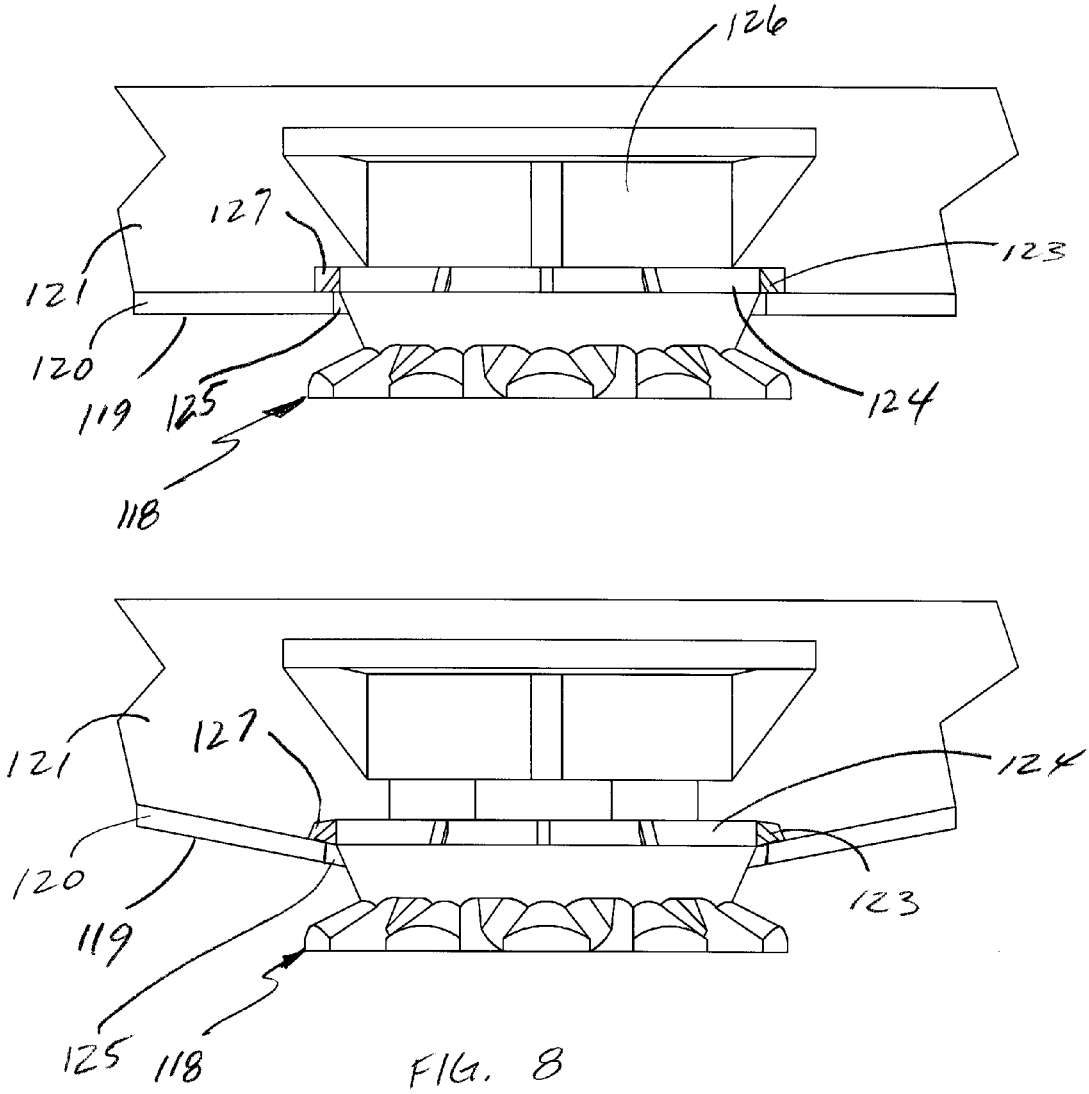
FIG. 8 is a partial cross-sectional side view of another embodiment of golf cleat and receptacle of the present invention attached to a sole of a golf shoe in accordance with the principles of the present invention.

As illustrated in FIG. 8, a golf spike 118 is configured to engage a sole 119 of a golf shoe in order to prevent debris, such as dirt or grass, from getting between the spike 118 and the sole 119. In this example, the sole 119 is formed from a wear layer 120 of a harder material that is laminated or otherwise bonded to a softer layer 121. The cleat 118 is provide with a plurality of tabs 123 that extend outwardly from the top portion 124 of the cleat 118. The tabs are formed from a flexible material, such as the plastic that forms the cleat 118, and are biased at an angled so that the top portion 124 of the cleat 118 can be inserted through an opening 125 in the layer 120 of the sole 119 where the cleat receptacle 126 resides. As the top portion 124 is inserted through the layer 119, the tabs 123 bend inwardly until they reside on the top side of the layer 119 at which point they spring open as shown. A circumferential channel 127 for receiving the tabs 123 is formed between the layer 120 and the layer 121. This channel 127 allows the cleat 118 to be rotated relative to the receptacle 126 as the cleat 118 adjusted relative to the receptacle. As the cleat 118 is rotated such that the cleat 118 become spaced further from the receptacle 126, the tabs 124 engage the top surface of the layer 120 such that the layer 120 at the location surrounding the cleat 118 is deflected to moves with the cleat 118. By forming the layer 121 from a relatively softer material, such as foam rubber, that can expand and contract as it is pulled and expanded or compressed by the movement of the layer 120, the thickness of the sole 119 can be adjusted along with adjustment of the cleat 118 so that any gap between the cleat 118 and the sole 119 is minimized.

Figure 9A:
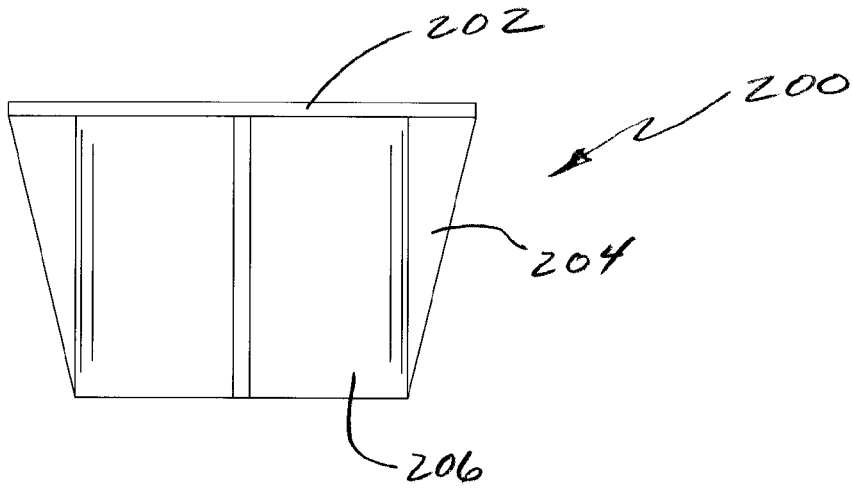
FIG. 9A is a side view of another embodiment of a golf shoe receptacle in accordance with the principles of the present invention.
Figure 9B:
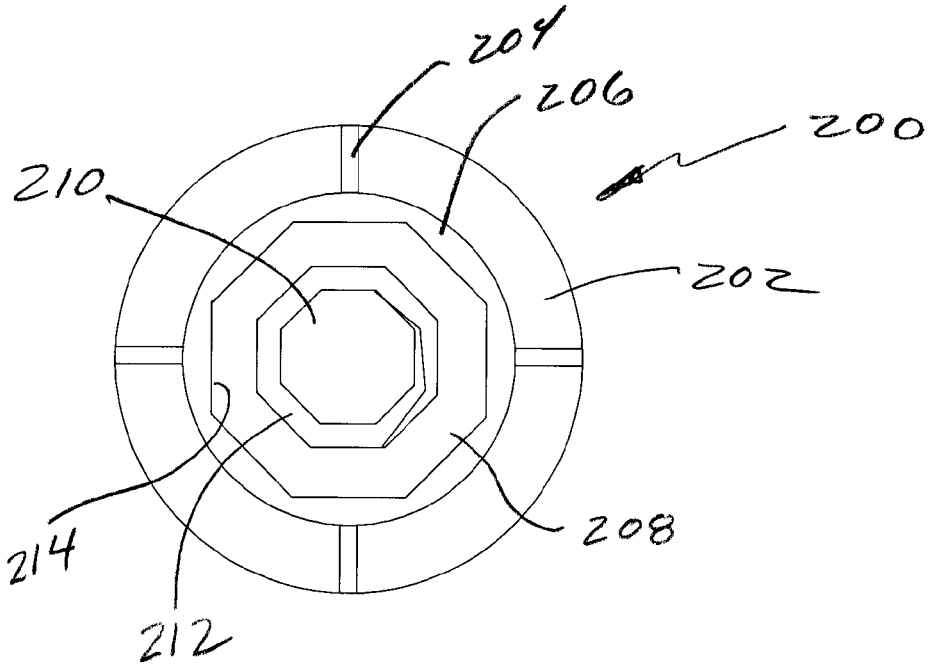
FIG. 9B is a bottom view of the golf shoe receptacle shown in FIG. 9A.

FIGS. 9A and 9B illustrate a receptacle 200 configured for attachment within the sole of a shoe and for receiving and securing a cleat in accordance with the principles of the present invention. The receptacle includes a top plate 202 and a plurality of side fins 204 for being embedded within a sole of a golf shoe that prevent the receptacle 200 from becoming dislodged or from being able to rotate relative to the sole of the shoe. The receptacle includes a first outer wall 206 that defines an inner, octagonal-shaped recess 208. The recess 2038 is configured to mate with an outer surface of a similarly shaped cleat body. Inside the recess 208 extends an externally threaded post 210. The post 210 has an octagonal outer shape and includes an octagonal "worm gear-type" thread 212 wrapping around the post 210. The cleat is provided with an octagonal-shaped inner recess having a cooperating worm gear-type thread for engaging with the thread 212. The octagonal shape of the work gear thread 212, post 210 and inner surface 214 of the post 210 allows the cleat to engage with and be held at discrete rotational positions relative to the receptacle 200. Thus, as the cleat is rotated relative to the receptacle 200, the cleat will snap at each point of rotation where the octagon features of the cleat and receptacle 200 align. As such, the cleat can be extended from the receptacle 200 by rotation but still remain firmly coupled to the receptacle 200 to prevent the cleat from become dislodged from the receptacle 200. Of course, other geometric shapes, while not specifically illustrated, may be employed within the spirit and scope of the invention, such as triangle, square, pentagon, hexagon, or other non-circular shape.

It should be noted that a cleat according to the principles of the present invention can be incorporated into any preexisting golf shoe. Accordingly, while the present invention has been described with reference to certain embodiments to illustrate what is believed to be the best mode of the invention, it is contemplated that upon review of the present invention, those of skill in the art will appreciate that various modifications and combinations may be made to the present embodiments without departing from the spirit and scope of the invention as recited in the claims. Reference herein to specific details of the illustrated embodiments is by way of example and not by way of limitation.

What is claimed is:

1. An adjustable golf cleat assembly configured for integrating with a golf shoe, comprising:

a receptacle configured for being fixedly attached to a sole of a golf shoe and defining a recess having an inner surface defining a non-circular shape and a longitudinally extending post disposed within said recess, said post having external threads thereon; and a cleat having a gripping portion for providing traction and an attachment portion extending from said gripping portion, said attachment portion having a non-circular shape outer surface substantially matching the non-circular shape of said inner surface of said recess and further defining an inner recess having internal threads disposed therein for engaging with said external threads of said receptacle;

whereby rotation of said cleat relative to said receptacle longitudinally moves said gripping portion relative to said receptacle and whereby engagement between said non-circular shape of said inner surface of said recess and said outer surface of said attachment portion maintains a relative position of said cleat and said receptacle.

2. The cleat assembly of claim 1, wherein said non-circular shapes of said inner surface of said recess and said outer surface of said attachment portion comprises one of a triangle, square, pentagon, hexagon and octagon.

3. The cleat assembly of claim 1, wherein said external and internal threads form an octagonally-shaped worm gear.

4. The cleat assembly of claim 1, wherein said receptacle includes a top plate and a plurality of longitudinal fins depending from said top plate and along an outer surface of said receptacle for preventing said receptacle from being removed or rotated relative to a sole of a shoe.

5. The cleat assembly of claim 1, wherein said gripping portion includes a plurality of protrusions, said plurality of protrusions comprising a plurality of radially-spaced blades and a plurality of radially-spaced feet, said blades and said feet having surfaces that are substantially planar.

6. The cleat assembly of claim 1, wherein said attachment portion includes a plurality of tabs laterally extending from said attachment portion for grasping a portion of a sole of a shoe surrounding said receptacle to cause said sole to move with said cleat upon rotation of said cleat relative to said receptacle.

7. The cleat of claim 1, wherein said non-circular shape of said inner surface of said recess and said outer surface of said attachment portion provide discrete rotational positions between said cleat and said receptacle to hold the cleat relative to the receptacle at a desired position.

8. The cleat of claim 1, wherein said gripping portion has an effective diameter that is greater than about 1.5 inches.

9. A golf shoe having a plurality of adjustable cleat assemblies attached to a sole of the golf shoe, comprising:

a sole;

a shoe upper attached to the sole;

a plurality of receptacles fixedly attached to a sole of a golf shoe and each defining a recess in said sole, said recess having an inner surface defining a non-circular shape and a longitudinally extending post disposed within said recess, said post having external threads thereon; and a plurality of cleats, each cleat having a gripping portion for providing traction and an attachment portion extending from said gripping portion for attaching to one of said plurality of receptacles, said attachment portion having a non-circular shape outer surface substantially matching the non-circular shape of said inner surface of said recess and further defining an inner recess having internal threads disposed therein for engaging with said external threads of said receptacle;

whereby rotation of each of said cleats relative to each of said receptacles longitudinally moves said gripping portion relative to said receptacle to selectively space said gripping portion from said receptacle and whereby engagement between said non-circular shape of said inner surface of said recess and said outer surface of said attachment portion maintains a relative position of each cleat and said receptacle.

10. The golf shoe of claim 9, wherein said non-circular shapes of said inner surface of said recess and said outer surface of said attachment portion comprises one of a triangle, square, pentagon, hexagon and octagon.

11. The golf shoe of claim 9, wherein said external and internal threads form an octagonally-shaped worm gear.

12. The golf shoe of claim 9, wherein each said receptacle includes a top plate and a plurality of longitudinal fins depending from said top plate and along an outer surface of said receptacle for preventing said receptacle from being removed or rotated relative to the sole.

13. The golf shoe of claim 9, wherein said gripping portion includes a plurality of protrusions, said plurality of protrusions comprising a plurality of radially-spaced blades and a plurality of radially-spaced feet, said blades and said feet having surfaces that are substantially planar.

14. The golf shoe of claim 9, wherein said gripping portions of said plurality of cleats substantially cover the sole of the shoe to form the primary walking surface of the shoe.

15. The golf shoe of claim 9, wherein said attachment portion of each said cleat includes a plurality of tabs laterally extending from said attachment portion for grasping a portion of the sole of the shoe proximate to each said receptacle to cause said sole to stretch or contract proximate said receptacle with movement of each said cleat relative to each said receptacle.

16. The golf shoe of claim 9, wherein said non-circular shape of said inner surface of said recess and said outer surface of said attachment portion provide discrete rotational positions between said cleat and said receptacle to hold the cleat relative to the receptacle at a desired position.

17. The golf shoe of claim 9, further comprising a plurality of sole adjustment members attached to said sole and each positioned proximate to one cleat of said plurality of cleats, each said sole adjustment member configured to stretch said sole relative to said one cleat.

18. The golf shoe of claim 9, wherein each of said plurality of sole adjustment members is attached to said sole proximate a perimeter thereof and is adjustable from a top surface of said sole adjacent said upper.

19. The golf shoe of claim 9, wherein each of said gripping portions has an effective diameter that is greater than about 1.5 inches.

* * * * *